US006324706B1

(12) United States Patent
Epple

(10) Patent No.: US 6,324,706 B1
(45) Date of Patent: Dec. 4, 2001

(54) AUTOMATIC POOL COVER BOX

(75) Inventor: Thomas A. Epple, Fort Wayne, IN (US)

(73) Assignee: Fort Wayne Pools, Inc., Fort Wayne, IN (US)

( * ) Notice: Subject to any disclaimer, the term of this patent is extended or adjusted under 35 U.S.C. 154(b) by 0 days.

(21) Appl. No.: 09/703,911

(22) Filed: Nov. 1, 2000

(51) Int. Cl.[7] ..... E04H 4/00
(52) U.S. Cl. ..... 4/502; 4/506
(58) Field of Search ..... 4/498, 502, 506

(56) References Cited

U.S. PATENT DOCUMENTS

| | | | | |
|---|---|---|---|---|
| 3,076,975 | * | 2/1963 | Lamb | 4/502 |
| 3,748,664 | * | 7/1973 | Morita | 4/502 |
| 4,203,174 | * | 5/1980 | Shultz | 4/502 |
| 5,555,574 | * | 9/1996 | Wason et al. | 4/502 |
| 5,860,413 | | 1/1999 | Bussey, Jr. et al. | 126/565 |
| 5,887,296 | | 3/1999 | Handwerker | 4/498 |
| 5,913,613 | | 6/1999 | Ragsdale et al. | 4/502 |
| 5,946,743 | | 9/1999 | Hashmi | 4/498 |

* cited by examiner

*Primary Examiner*—Charles E. Phillips
(74) *Attorney, Agent, or Firm*—Taylor & Aust, P.C.

(57) ABSTRACT

An automatic pool cover box includes a front wall having a plurality of elongated extrusions, each extrusion having a first side wall, an opposite second side wall, a first coupler on the first side wall and a second coupler on the second side wall. Adjacent extrusions are coupled together using a respective first coupler and second coupler. A second side wall of one of the extrusions defines a bottom edge of the front wall. A rear wall includes a plurality of elongated extrusions, each extrusion having a first side wall, an opposite second side wall, a first coupler on the first side wall and a second coupler on the second side wall. Adjacent extrusions are coupled together using a respective first coupler and second coupler. A second side wall of one of the extrusions defines a bottom edge of the rear wall which is at least intermittently connected with the bottom edge of the front wall. A lid includes a plurality of elongated extrusions, with each extrusion having a first side wall, an opposite second side wall, a first coupler on the first side wall and a second coupler on the second side wall. Adjacent extrusions are coupled together using a respective first coupler and second coupler. A hinge member interconnects the rear wall and the lid. The hinge member is coupled with the rear wall in a vertically adjustable manner and is hingably coupled with the lid.

17 Claims, 3 Drawing Sheets

AUTOMATIC POOL COVER BOX

BACKGROUND OF THE INVENTION

1. Field of the Invention

The present invention relates to swimming pools, and, more particularly, to an automatic pool cover box used to house an automatic pool cover.

2. Description of the Related Art

Swimming pools are commonly covered to prevent debris from entering the pool and to heat the pool in the case of a solar cover. An automatic pool cover provides convenience for a user by allowing the cover to be easily extended over the pool during periods of non-use, and retracted during periods of use. Typically, a box is placed in the decking surrounding the pool at a location opposite from the walk-in steps (usually at the deep end of a pool). The box extends across the width of the pool, and houses an electric motor and reel on which the cover is wound.

A problem with conventional automatic pool cover boxes is that they are typically constructed from treated lumber and manufactured on-site at the pool location. The box is usually constructed from treated 2×12's which are coupled together in an end-to-end manner corresponding to the width of the pool and additional space at each longitudinal end required for the drive motor and mounting brackets. For example, a swimming pool having a width of 20 feet typically requires a automatic pool cover box of about 26 feet in length. To prevent deflection of the 2×12 walls relative to each other, cross members in the form of 2×4's or the like are fastened to the 2×12 side walls at period locations along the length of the box. It will be appreciated that the weight of a box constructed primarily from 2×12's which is 26 feet long is very heavy. Moreover, depending upon the skill of the installers, the quality of the box may vary from one installation to another.

What is needed in the art is an automatic pool cover box which is easy to assembly on-site, provides uniformity of construction from one installation to another, is light weight, and adjustable.

SUMMARY OF THE INVENTION

The present invention provides an automatic pool cover box having a front wall, rear wall and lid constructed from modular components which may be easily connected together on-site and adjusted relative to each other to provide an optimum installation.

The invention comprises, in one form thereof, an automatic pool cover box including a front wall having a plurality of elongated extrusions, each extrusion having a first side wall, an opposite second side wall, a first coupler on the first side wall and a second coupler on the second side wall. Adjacent extrusions are coupled together using a respective first coupler and second coupler. A second side wall of one of the extrusions defines a bottom edge of the front wall. A rear wall includes a plurality of elongated extrusions, each extrusion having a first side wall, an opposite second side wall, a first coupler on the first side wall and a second coupler on the second side wall. Adjacent extrusions are coupled together using a respective first coupler and second coupler. A second side wall of one of the extrusions defines a bottom edge of the rear wall which is at least intermittently connected with the bottom edge of the front wall. A lid includes a plurality of elongated extrusions, with each extrusion having a first side wall, an opposite second side wall, a first coupler on the first side wall and a second coupler on the second side wall. Adjacent extrusions are coupled together using a respective first coupler and second coupler. A hinge member interconnects the rear wall and the lid. The hinge member is coupled with the rear wall in a vertically adjustable manner and is hingably coupled with the lid.

An advantage of the present invention is that the automatic pool cover box is constructed from substantially identical extrusions, thereby reducing the part count of different types of parts.

Another advantage is that the box may be easily assembled on-site, without substantial variance from one installation to another.

Yet another advantage is that the lid may be adjusted in a vertical manner relative to the rear wall, thereby providing optimum fit and slope to the lid.

A further advantage is that a wear bar may be attached to the top edge of the front wall to inhibit wear of the cover during extension and retraction.

Still another advantage is that a coping may be directly carried by the lid.

Another advantage is that the leading edge bar may include a coping with a leading edge which is substantially the same as the remaining coping of the pool, and a trailing edge which mates with the coping carried by the lid.

Yet another advantage is that the box is very light weight when compared with conventional designs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
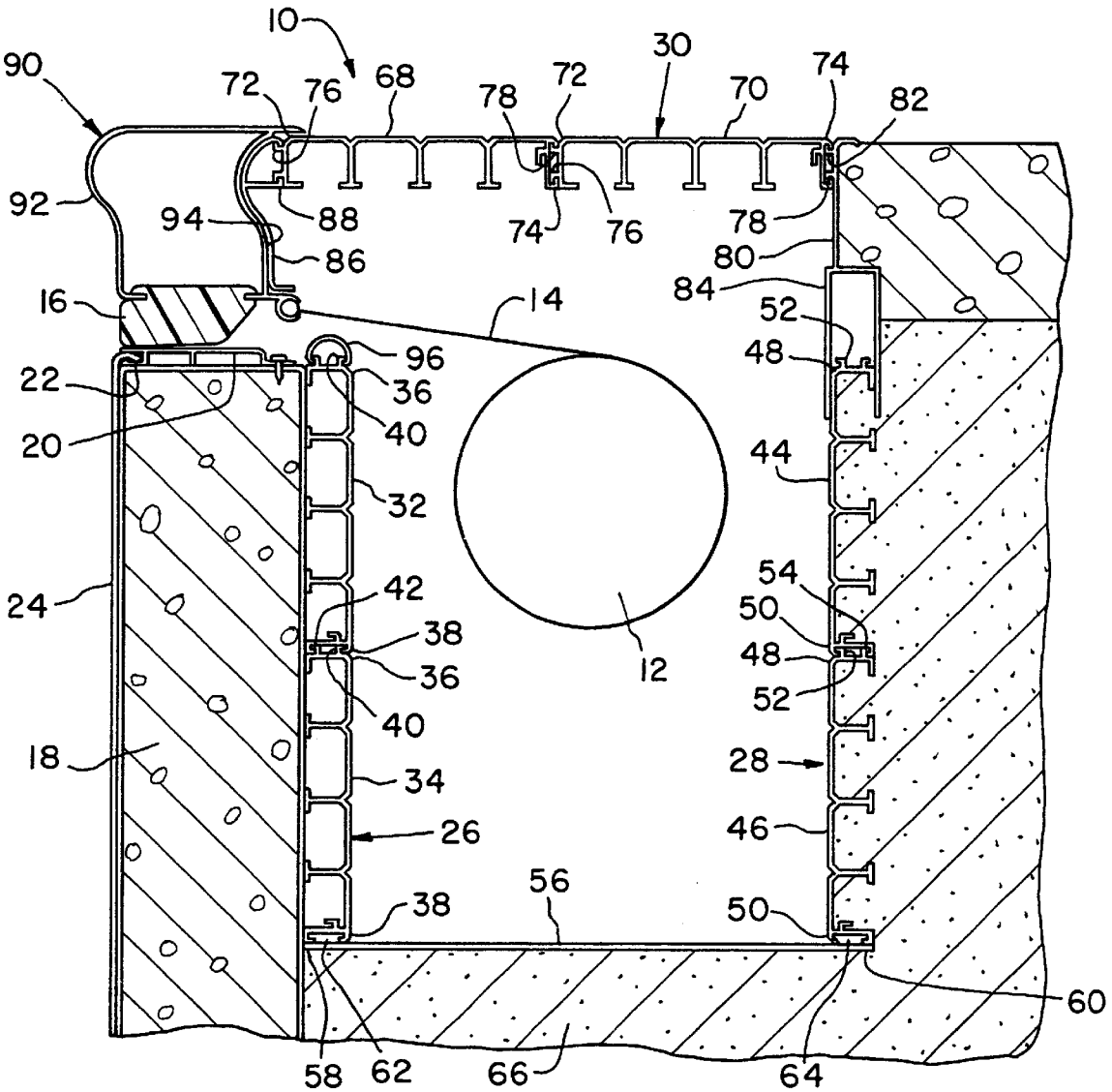
FIG. 1 is an end, sectional view of an embodiment of an automatic pool cover box of the present invention.

Referring now to the drawings, and more particularly to FIG. 1, there is shown an embodiment of an automatic pool cover box 10 of the present invention. Box 10 is used to house a reel 12 and cover 14. Reel 12 is coupled with an electric motor (not shown) which is used to rotatably drive reel 12 to move cover 14 to the open position, as shown in FIG. 1. Cover 14 wraps around reel 12 a number of times corresponding to the length of the pool. Cover 14 is coupled at the leading edge thereof with a leading edge bar 16.

Box 10 is positioned adjacent a side wall 18 of the pool. An end cap coping 20 is positioned at the top of side wall 18, and includes a liner bead slot 22 from which a vinyl liner 24 is suspended. Side wall 18 may be of any suitable construction, such as a thermoplastic, metal or concrete wall. Of course, liner 24 may not be necessary, dependent upon the particular construction of side wall 18.

According to an aspect of the present invention, box 10 is constructed in a modular manner from a plurality of substantially identical extrusions which define a front wall 26, rear wall 28 and lid 30. Front wall 26 is constructed from a pair of substantially identical elongated extrusions 32 and 34. Each extrusion 32 and 34 includes a first side wall 36 and an opposite second side wall 38. A first coupler 40 in the form of a pair of flanges is positioned on first side wall 36; and a second coupler 42 in the form of a pair or mating flanges is positioned on second side wall 38. First side wall 36 of extrusion 32 defines a top edge of front wall 26, and second side wall 38 of extrusion 34 defines a bottom edge of front wall 26.

Figure 2:
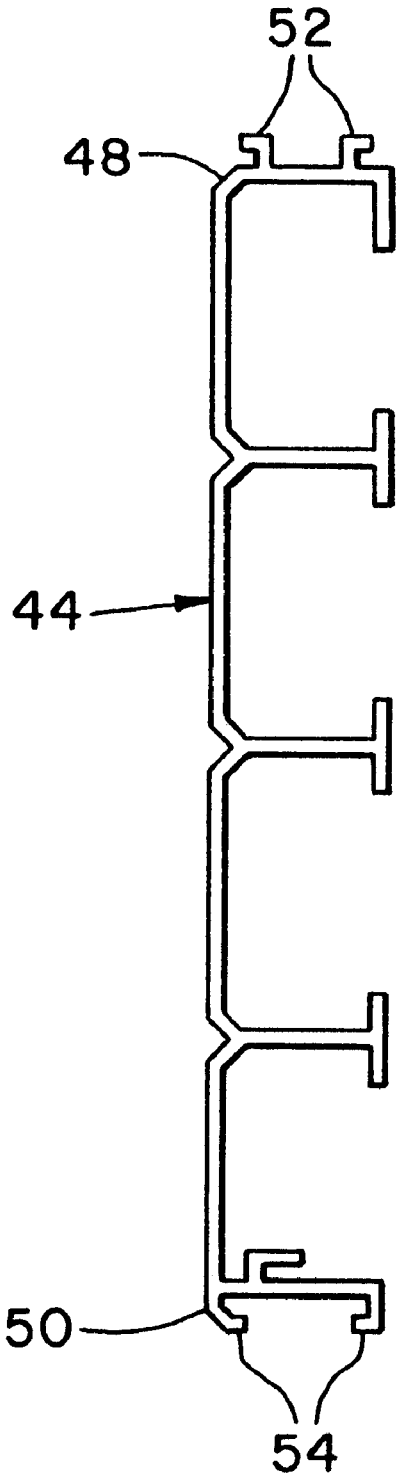
FIG. 2 is an end view of an extrusion shown in FIG. 1.

Rear wall 28 includes a pair of substantially identically configured elongated extrusions 44 and 46 (extrusion 44 is shown in detail in FIG. 2). Each extrusion 44 and 46 includes a first side wall 48 and a second side wall 50. A first coupler 52 in the form of a pair of flanges is positioned on first side wall 48 and a second coupler 54 in the form of a pair of mating flanges is positioned on second side wall 50. Second coupler 54 of extrusion 44 is coupled with first coupler 52 of extrusion 46 to define rear wall 28. Extrusion 44 may be slid in a longitudinal direction (perpendicular to the drawing of FIG. 1) relative to extrusion 46 to effect the interconnection between first coupler 52 and second coupler 54. First side wall 48 of extrusion 44 defines a top edge of rear wall 28, and second side wall 50 of extrusion 46 defines a bottom edge of rear wall 28.

Bottom wall 56 includes opposite side edges 58 and 60. A pair of first couplers 62 and 64 extend upwardly from bottom wall 56 at respective side edges 58 and 60. First coupler 62 is connected with second coupler 42 of extrusion 34. First coupler 64 is connected with second coupler 54 of extrusion 46. Bottom wall 56 may include perforations or openings (not shown) therein for allowing water to drain into earth 66 surrounding box 10.

Lid 30 includes a pair of substantially identical extrusions 68 and 70. Extrusions 68 and 70 each include a first side wall 72 and a second side wall 74. A first coupler 76 in the form of a pair of flanges is positioned at first side wall 72, and a second coupler 78 in the form of a pair of mating flanges is positioned at second side wall 74. Second coupler 78 of extrusion 68 is coupled with first coupler 76 of extrusion 70 in a manner as described above with reference to extrusions 32, 34 and 44, 46.

Hinge member 80 includes a first coupler 82 and a U-shaped lower portion 84. First coupler 82 hingably connects with second coupler 78 of lid extrusion 70. U-shaped lower portion 84 slides over the top edge of rear wall 28. Hinge member 80 is positioned at a desired vertical position relative to rear wall 28, and fastened thereat with rear wall 28. For example, self tapping metal screws may be used to couple one or both legs of U-shaped lower portion 84 with extrusion 44. By providing vertical adjustment of hinge member 80, the slope of lid 30 can be varied, thereby ensuring that a suitable slope is provided to allow water to drain from the top of lid 30.

First side wall 72 of extrusion 68 defines a front edge of lid 30. A coping 86 includes a second coupler 88 which couples coping 86 with extrusion 68. Coping 86 is thereby attached with and carried by lid 30.

Leading edge bar 16 includes a coping 90 which extends upwardly therefrom. Coping 90 includes a leading edge 92 and a trailing edge 94. Leading edge 92 has a shape which is substantially the same as coping 86. Thus, when leading edge bar 16 is positioned against coping 86 as shown in FIG. 1, leading edge 92 has the effect of merely replacing coping 86. Trailing edge 94 has a shape which is complimentary to coping 86. Thus, when leading edge bar 16 is against coping 86 as shown in FIG. 1, trailing edge 94 of coping 90 substantially conforms to the shape of coping 86, thereby preventing downward deflection of coping 90 while cover 14 is in the open position as shown.

Wear bar 96 is connected with first coupler 40 of extrusion 32. Wear bar 96 extends substantially across the length of extrusion 32 (in a direction perpendicular to the drawing of FIG. 1) and provides a smooth surface over which cover 14 may slide when being extended and retracted. In the embodiment shown, wear bar 96 has a substantially semi-circular shape with a smooth outer periphery. Wear bar 96 may be coated with a low friction material such as Teflon®, etc. to allow easier sliding and inhibit wear of cover 14 during extension and retraction thereof.

In the embodiment shown in FIG. 1, extrusions 32, 34 of front wall 26, extrusions 44, 46 of rear wall 28, and extrusions 68, 70 of lid 30 are all substantially identical to each other. However, it is to be understood that front wall 26, rear wall 28 and/or lid 30 may include one or more extrusions which are differently configured. For simplicity and reduction of parts count, however, extrusions 32, 34, 44, 46, 68 and 70 are preferably all configured substantially identical.

Figure 3:
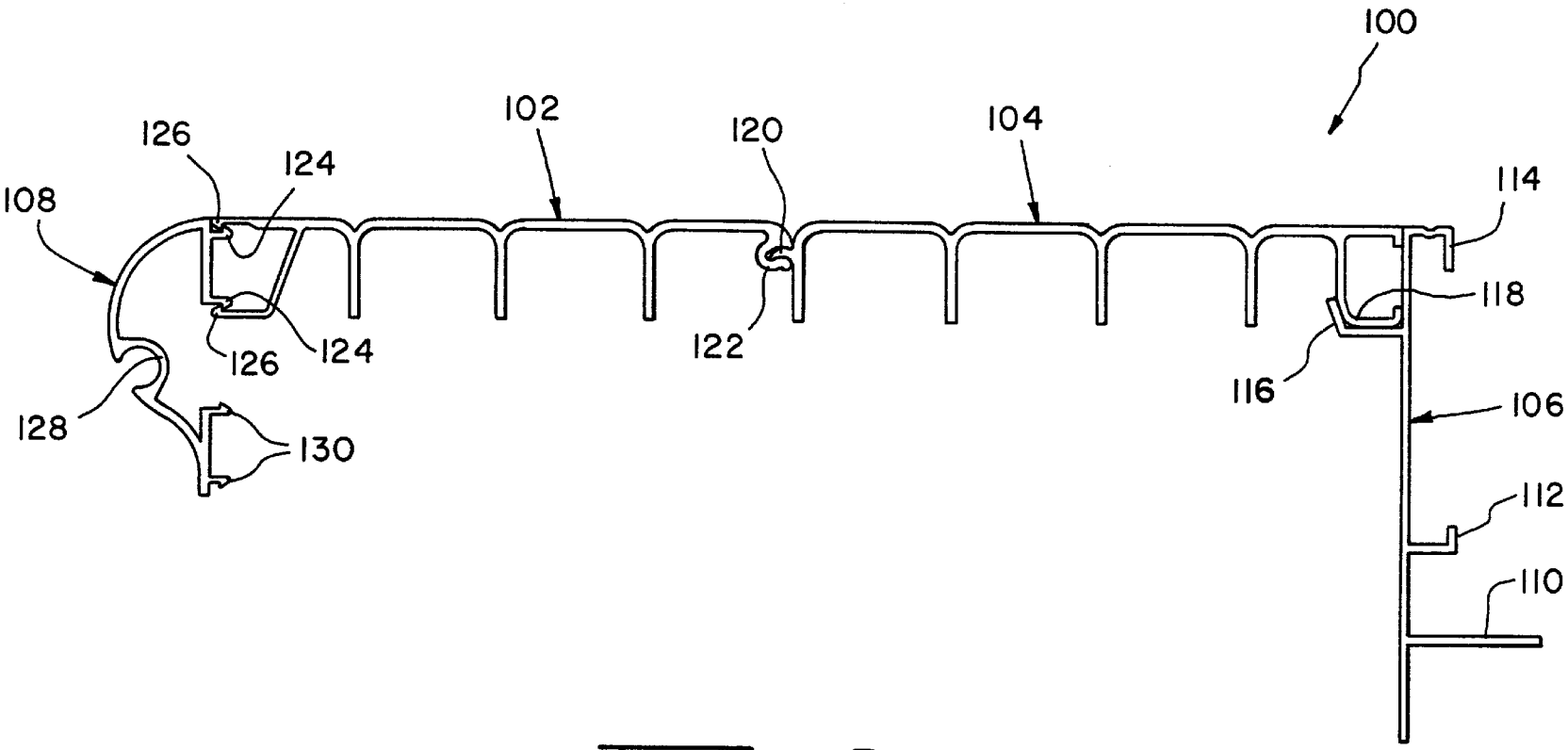
FIG. 3 is an end, sectional view of another embodiment of a lid used with an automatic pool cover box of the present invention.

Referring now to FIG. 3, there is shown another embodiment of a lid 100 which may be utilized with an automatic pool cover box of the present invention. Lid 100 also includes two extruded aluminum pieces which couple together, similar to lid 30 shown in FIG. 1. More particularly, lid 100 includes a first extrusion 102, a second extrusion 104, a hinge member 106 and a coping 108.

Hinge member 106 includes an L-shaped lower portion 110 which rests on top of the rear wall of the cover box (not shown). Lower portion 110 may be fastened to the top of the rear wall using suitable fasteners, such as self-tapping screws. Leg 112 and downwardly depending flange 114 allow interconnection with a concrete deck (not shown) poured against hinge member 106. Hinge 116 provides pivotal attachment with second extrusion 104.

Second extrusion 104 includes rearward C-shaped portion 118 which rests on and provides pivotal movement relative to hinge 116. Male projection 120 of second extrusion 104 and female recess 122 of first extrusion 102 allow interconnection between first extrusion 102 and second extrusion 104. Projection 120 and recess 122 are configured such that interference therebetween occurs when first extrusion 102 and second extrusion 104 are disposed generally parallel to each other as shown in FIG. 3. First extrusion 102 and second extrusion 104 will not deflect further in a downward direction relative to each other, but can be in essence hinged about projection 120 and recess 122 in an upward direction to allow lid 100 to be disassembled or to allow lid 100 to be removed from the cover box.

Coping 108 includes male projections 124 which mate with corresponding male projections 126 of first extrusion 102. The top projection 126 of first extrusion 102 has a thinned section near the distal end thereof allowing lateral flexure for interconnection with projections 124 without permanent deformation thereof. Each of projections 124 and projections 126 include a beveled mating face such that a transverse force component is applied to each of projections 126 upon insertion of projections 124 of coping 108. Coping 108 also includes a fiber optic slot 128 for receiving a fiber optic cable (not shown) surrounding the swimming pool. A pair of lower male projections 130 allow interconnection with an optional structural support (not shown) extending across the width of the automatic cover box to provide further structural support to lid 100 and thereby prevent downward deflection thereof. The particular configuration of the additional structural support may vary, depending upon the strength requirements for the particular application.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An automatic pool cover box, comprising:

a front wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler;

a rear wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said rear wall at least intermittently connected with said front wall; and a lid including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said lid being hingably connected with said rear wall.

2. The automatic pool cover box of claim 1, including a hinge member interconnecting said rear wall and said lid, said hinge member being coupled with said rear wall in a vertically adjustable manner and being hingably coupled with said lid.

3. The automatic pool cover box of claim 2, wherein said first side wall of one of said rear wall extrusions defines a top edge of said rear wall, said hinge member including a generally U-shaped lower portion which fits over said top edge of said rear wall.

4. The automatic pool cover box of claim 1, wherein said first side wall of one of said front wall extrusions defines a top edge of said front wall, and further including a wear bar coupled with said first coupler at said top edge.

5. The automatic pool cover box of claim 1, wherein said first side wall of one of said lid extrusions defines a front edge of said lid, and further including a coping coupled with said first coupler at said front edge.

6. The automatic pool cover box of claim 1, wherein said second side wall of one of said front wall extrusions defines a bottom edge of said front wall, and said second side wall of one of said rear wall extrusions defines a bottom edge of said rear wall, said bottom edge of said front wall being substantially continuously connected with said bottom edge of said rear wall.

7. The automatic pool cover box of claim 6, including a bottom wall with a pair of opposite side edges and a pair of first couplers respectively positioned at said side edges, one of said first couplers on said bottom wall coupled with said second coupler on said bottom edge of said front wall, an other of said first couplers on said bottom wall coupled with said second coupler on said bottom edge of said rear wall.

8. The automatic pool cover box of claim 1, wherein each said extrusion of said front wall, said rear wall and said lid are the same.

9. The automatic pool cover box of claim 8, wherein each said first coupler comprises a pair of flanges, and each said second coupler comprises a pair of mating flanges.

10. An automatic pool cover box, comprising:

a front wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, a second side wall of one of said extrusions defining a bottom edge of said front wall;

a rear wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, a second side wall of one of said extrusions defining a bottom edge of said rear wall which is at least intermittently connected with said bottom edge of said front wall;

a lid including a plurality of elongated extrusions, each said extrusion having a first side wall, an opposite second side wall, a first coupler on said first side wall and a second coupler on said second side wall, adjacent said extrusions being coupled together using a respective said first coupler and said second coupler; and a hinge member interconnecting said rear wall and said lid, said hinge member being coupled with said rear wall in a vertically adjustable manner and being hingably coupled with said lid.

11. The automatic pool cover box of claim 10, wherein said first side wall of one of said rear wall extrusions defines a top edge of said rear wall, said hinge member including a generally U-shaped lower portion which fits over said top edge of said rear wall.

12. An automatic pool cover box, comprising:

a front wall including a bottom edge;

a rear wall including a top edge and a bottom edge, said bottom edge of said rear wall being at least intermittently connected with said bottom edge of said front wall;

a lid having a rear edge; and a hinge member interconnecting said top edge of said rear wall and rear edge of said lid, said hinge member being coupled with said rear wall in a vertically adjustable manner.

13. The automatic pool cover box of claim 12, wherein said hinge member includes a generally U-shaped lower portion which fits over said top edge of said rear wall.

14. An automatic pool cover box, comprising:

a front wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said first side wall of one of said extrusions defining a front edge of said lid;

a rear wall including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said rear wall at least intermittently connected with said front wall;

a lid including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said lid being hingably connected with said rear wall; and a coping coupled with said first coupler at said front edge of said lid.

15. An automatic pool cover box, comprising:

a front wall including a bottom edge;

a rear wall including a top edge and a bottom edge, said bottom edge of said rear wall being at least intermittently connected with said bottom edge of said front wall;

a lid having a front edge and a rear edge, said rear edge being hingably connected with said top edge of said rear wall; and a coping coupled with and carried by said front edge of said lid.

16. An automatic pool cover box, comprising:

a rear wall;

a lid including a plurality of elongated extrusions, each said extrusion having a first side wall, an opposite second side wall, a first coupler on said first side wall and a second coupler on said second side wall, adjacent said extrusions being coupled together using a respective said first coupler and said second coupler, said lid being hingably connected with said rear wall; and a coping coupled with said first coupler at said front edge of said lid.

17. The automatic pool cover box of claim 16, including a hinge member interconnecting said rear wall and said lid, said hinge member having a lower portion with one of a U-shaped configuration and a L-shaped configuration for coupling with a top of said rear wall.

* * * * *